United States Patent [19]

Mitsumori

[11] Patent Number: 4,758,765

[45] Date of Patent: Jul. 19, 1988

[54] BLACK LAYER FOR THIN FILM EL DISPLAY DEVICE

[75] Inventor: Kenichi Mitsumori, Furukawa, Japan

[73] Assignee: Alps Electric Co., Ltd., Japan

[21] Appl. No.: 872,214

[22] Filed: Jun. 6, 1986

[30] Foreign Application Priority Data

Jun. 7, 1985 [JP] Japan ..... 60-123880

[51] Int. Cl.[4] ..... H01J 1/62

[52] U.S. Cl. ..... 313/506; 313/503; 315/169.3

[58] Field of Search ..... 315/169.3; 313/503, 313/505, 506, 509; 427/66; 428/917; 340/760, 761, 781, 825.81

[56] References Cited

U.S. PATENT DOCUMENTS 4,418,118 11/1983 Lindfors ..... 313/506

4,672,264 6/1987 Higton ..... 313/503

FOREIGN PATENT DOCUMENTS 2074787 11/1981 United Kingdom ..... 313/509

*Primary Examiner*—David K. Moore
*Assistant Examiner*—Theodore Salindong
*Attorney, Agent, or Firm*—Guy W. Shoup; Leighton K. Chong

[57] ABSTRACT

A thin film EL display device having an EL light emitting layer sandwiched between a transparent electrode and an opposing electrode, wherein a light absorbing black layer containing constituent ingredients for the EL emission layer is disposed at the back of the EL emission layer. The external incident light is not reflected but absorbed well into the light absorbing layer to enable an improvement in the display contrast.

7 Claims, 2 Drawing Sheets

BLACK LAYER FOR THIN FILM EL DISPLAY DEVICE

BACKGROUND OF THE INVENTION

1. Field of the Invention

This invention concerns a thin film electroluminescent display device, in which an electroluminescent (hereinafter simply referred to as EL) emission layer is disposed between a transparent electrode and an opposing electrode and a voltage is applied to the EL emission layer to cause light emission.

2. Description of the Prior Art

Thin film El display devices have been applied to various kinds of displays in recent years and they are generally classified into AC driving and DC driving types. Thin film EL display devices in the prior art have generally been constituted, for example, as shown in FIG. 4 as a 8-layered structure having double insulation films, in which a transparent electrode 2, an insulation layer 3, an EL emission layer 4, an insulation layer 5 and an opposing electrode 6 are laminated successively on a glass substrate 1. The thin film EL display device is adapted such that an alternating electric field from several tens Hz to several KHz is applied between the transparent electrode 2 and the opposing electrode 6 to excite ions of activated species in the EL emission layer 4 to cause light emission.

The important feature of the thin film EL display device when it is used as a display, like other display devices (for example, liquid crystals), is that the displayed contents can clearly be observed visually under the brightness of sun light at the outdoor and under the brightness of various kinds of illuminations in a room. A metal film such as aluminum is used as the opposing electrode 6 of the thin film EL display device. Particularly, since the aluminum film has a high metallic gloss, an external light is reflected at the surface of the opposing electrode 6 in the thin film EL display device and observed together with the light emitted from the EL emission layer 4. Accordingly, in the case where the external light is highly bright, it is difficult to discriminate the emission portion from the non-emission portion of the EL emission layer 4 in the conventionally thin film EL display device, which makes it difficult to read the display.

In view of the above, various attempts have been made for improving the display contrast. For instance, it has been known to introduce black materials in the glass substrate 1 or attach a black filter. However, in such an EL display device, although the reflection light can surely be decreased since the side of the display surface is blackened, the EL emission is also decreased thereby, to provide only an insufficient effect for the improvement of the contrast.

Further, as shown in FIG. 5, there has also been known a device in which a black light absorbing layer 7 is disposed between the insulation layer 5 at the back of the EL emission layer 4 and the opposing electrode 6. In this case, since the light absorbing layer 7 is disposed at the back of the EL emission layer 4, reduction in the EL light emission caused by the light absorbing layer 7 can be alleviated. However, as shown in FIG. 6, the incident light such as illumination light is tended to be partially reflected at the interface between the insulation layer 5 and the light absorbing layer 7 and the reflection light at the interface between the insulation layer 5 and the light absorbing layer 7 is observed as a black metallic color on the side of the display surface, which results in no sufficient contrast.

OBJECT OF THE INVENTION

It is, accordingly, an object of this invention to provide a thin film EL display device capable of overcoming the foregoing problems in the prior art, improving the contrast in the display and enabling to clearly observe the disposed contents even at a bright place.

SUMMARY OF THE INVENTION

The foregoing object of this invention can be attained by a thin film EL display device having an EL emission layer sandwiched between a transparent electrode and an opposing electrode, wherein a light absorbing black layer containing constituent ingredients of the EL emission layer is disposed at the back of the EL emission layer.

BRIEF DESCRIPTION OF THE APPENDED DRAWINGS

These and other objects, features as well as advantage of this invention will become clearer by the following descriptions for the preferred embodiments thereof made in conjunction with the appended drawings, wherein FIG. 1 is a cross sectional view for one embodiment of a thin film EL display device according to this invention;

DESCRIPTION OF THE PREFERRED EMBODIMENTS

Figure 2:
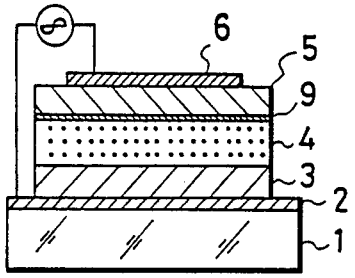
FIG. 2 is a cross sectional view for another embodiment of a thin film EL display device according to this invention.

Explanation will be made to preferred embodiments of a thin film EL display device according to this invention more in details.

The thin film EL display device according to this invention has a 7-layered structure in which a transparent electrode, an insulation film, an EL emission layer, a light absorbing black layer, an insulation layer and an opposing electrode are successively laminated, for example, on a glass substrate. In this case, one of the insulation films may be omitted. Further, the light absorbing black layer may be disposed between the insulation film formed at the back of the EL emission layer and the insulation film. Then, the EL emission layer emits light upon application of an electric field between the transparent electrode and the opposing electrode.

In this invention, black material containing constituent ingredients for the EL emission layer is used as the light absorbing black layer. For instance, in a case where the matrix of the EL emission layer is made of zinc sulfide and contains metal or metal compound as the emission centers, zinc sulfide ($ZnS_x$ ($0<x<1$)) or zinc sulfide doped with metal or metal compound ($ZnS_x$:M ($0<x<1$), M=metal or metal compound) or the like can be used as the light absorbing layer. M in the metal or metal compound—doped zinc sulfide ($ZnS_x$:M) can include more specifically manganese, rare earth elements and halides of rare earth elements. In this way, it is possible to render the EL light emission clearer and the contrast satisfactory by preventing the reflection at the interface of the light absorbing layer by disposing a light absorbing black layer containing the constituent ingredients for the EL emission layer at least other than the emission centers.

As a specific method of forming the light absorbing black layer, RF-sputtering method is adopted for instance. For example, in the case of forming a light absorbing layer comprising zinc sulfide ($ZnS_x$, ($0<x<1$)) or manganese (Mn)—doped zinc sulfide ($ZnS_x$:Mn ($0<x<1$)), a ZnS target or ZnS:Mn target is used, while helium (He) gas is used as a sputtering gas. When the ZnS target or ZnS:Mn target is subjected to RF sputtering with an argon (Ar) gas at a pressure of about 1 Pa, a transparent ZnS film or ZnS:Mn film is formed, while a black $ZnS_x$ ($0<x<1$) or $ZnS_x$:Mn ($0<x<1$) film is formed when a helium gas (He) is used within a range of gas pressure about from 1 to 10 Pa instead of the argon gas. While the color density varies depending on the film thickness of the light absorbing layer, a film thickness of about several hundred Å is sufficient. Further, the hue can be varied by changing the thickness of the light absorbing layer.

In this invention, if the light absorbing black material is made of the same material as that for the EL emission layer, the light absorbing layer can be formed in continuous with the formation of the EL emission layer by merely exchanging the sputtering gas from argon to helium continuously. After forming the EL emission layer in this way, when the light absorbing layer is formed continuously by exchanging the sputtering gas, since the EL emission layer and the light absorbing layer are continuously formed with interface therebetween, the interface between the EL emission layer and the light absorbing layer is eliminated, by which the incident light is not reflected but sufficiently absorbed into the light absorbing layer to further improve the contrast in the display.

EXAMPLE 1

Figure 1:
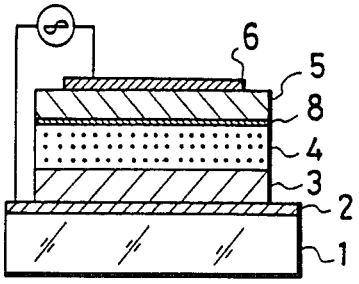

As shown in FIG. 1, a transparent electrode 2 made of $In_2O_3$—$SnO_2$ series was formed to a thickness of about 2000 Å on a commercially available glass substrate (Corning #7059) 1 by way of sputtering and a composite insulation layer 3 made of $Si_3N_4$ and $SiO_2$ was formed thereover to a thickness of about 300 Å also by way of sputtering. An EL emission layer 4 made of ZnS:Mn (0.5 wt%) was formed to a thickness of about 8000 Å on the insulation layer 3 by way of sputtering and a light absorbing black layer 8 made of $ZnS_x$ ($0<x<1$) was formed thereover to a thickness of about 200 Å under the presence of a helium (He) gas at a pressure of about 1 Pa. Then, an insulation layer 5 comprising a composite product of $Si_3N_4$ and $SiO_2$ was formed to a thickness of about 3000 Å by way of a sputtering and, finally, aluminum was vapor-deposited to form an opposing electrode 6 to a thickness of about 1500 Å to obtain a thin film EL display device.

EXAMPLE 2

As shown in FIG. 2, a transparent electrode 2 made of $In_2O_3$—$SnO_2$ series was formed to a thickness of about 2000 Å on a commercially available glass substrate (Corning #7059) 1 by way of sputtering and an insulation layer 3 made of $Ta_2O_5$ was further formed thereover to a thickness of about 3000 Å also by way of sputtering. Then, an EL emission layer 4 made of ZnS:Mn (0.5 wt%) was formed on the insulation layer 3 by way of sputtering and, continuously thereto, a black light absorbing layer 9 made of $ZnS_x$:Mn ($0<x<1$) was formed to a thickness of about 200 Å by continuously replacing the sputtering gas from argon to helium (He) and under the presence of helium (He) gas at a pressure of about 1 Pa. Then, an insulation layer 5 made of $Ta_2O_5$ was formed by way of sputtering and, finally, aluminum was vacuum-deposited to form an opposing electrode 8 to obtain a thin film EL display device. In this thin film EL display device, no distinct interface was formed between the EL emission layer 4 and the light absorbing layer 9 to provide a continuously varying layer.

Figure 3:
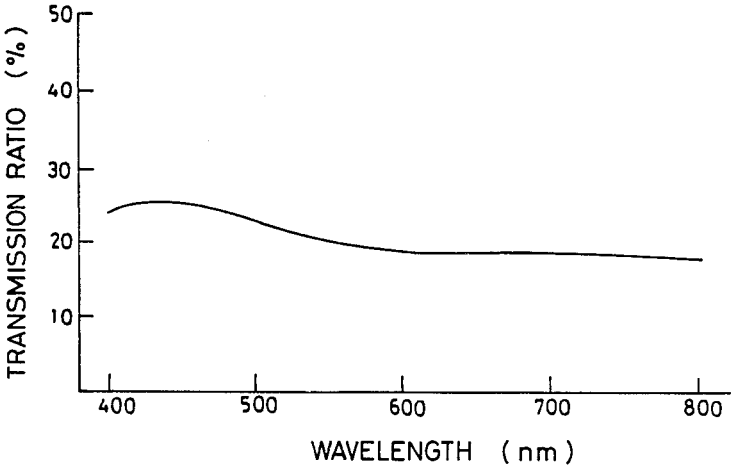
FIG. 3 is a chart showing a visible ray transmission spectrum in the light absorbing black layer.
Figure 4:
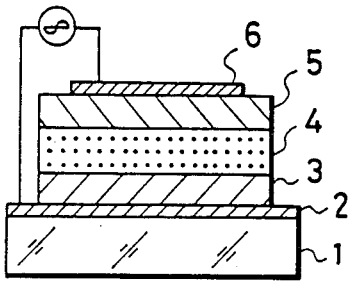
FIG. 4 PRIOR ART
FIG. 4 is a cross sectional view for one embodiment of a conventional thin film EL display device.
Figure 5:
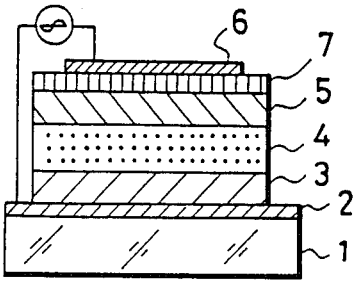
FIG. 5 PRIOR ART
FIG. 5 is a cross sectional view for another embodiment of a conventional thin film EL display device.
Figure 6:
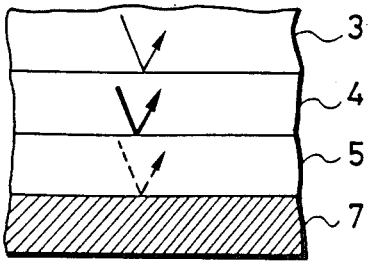
FIG. 6 PRIOR ART
FIG. 6 is a cross sectional view showing the reflection state of incident light in the thin film EL display device shown in FIG. 4.

When each of the thin film EL display devices manufactured in this way was observed from the display surface, the contrast between the light-emitting portion and the not light-emitting portion of the EL emission emitting layer 4 was satisfactory as can be seen from the visible ray transmission spectrum for the light black absorbing layer in FIG. 3.

Conditions for making the film of ZnS, $ZnS_x$ ($0<x<1$) and ZnS:Mn (Mn=0.5 wt%, $0<x<1$) in Examples 1 and 2 are shown in Table 1.

TABLE 1

| Material | Target | Sputtering gas | He gas pressure | Film forming rate | Substrate temperature | Outer color |
|---|---|---|---|---|---|---|
| ZnSx ($0<x<1$) | ZnS Ceramic target | He(5N) (Ar + He) | 1~10 Pa | 2~10 Å/min | ~150° C. | dark black |
| ZnSx:Mn ($0<x<1$) | ZnS:Mn Ceramic target | He(5N) (Ar + He) | 1~10 Pa | 2~10 Å/min | ~150° C. | dark black |
| ZnS | ZnS Ceramic target | Ar | ~1 Pa | 110~140 Å/min | ~130° C. | Transparent yellow (nearly colorless) |

As has been described above according to this invention, since a light absorbing black layer comprising the same constituents elements for the EL emission matrix is disposed at the back of the EL emisson layer, the incident light from the outside, for example, illumination light is less reflected at the interface between the EL emission layer and the light absorbing layer, by which the incident light from the outside can efficiently be absorbed in the light absorbing layer, to improve the contrast in the display. Further, according to this invention, the EL emission layer and the light absorption layer can easily be formed by merely replacing the sputtering gas. Accordingly, when the sputtering gas is properly selected, the emission layer and the light absorbing layer can be formed continuously with no interface therebetween. As a result, the interface between the EL emission layer and the light absorption layer can be eliminated, by which the incident light is not reflected but can be absorbed well into the absorbing layer to further improve the contrast in the display.

What is claimed is:

1. A thin film EL display device having an EL emission layer disposed between a transparent electrode in front and an opposing electrode in back, wherein a light absorbing black layer is provided in back of said EL emission layer and is composed of a material made of the same chemical elements as those of a light emitting material of said EL emission layer, but said black layer material is not the same as the light emitting material of said EL emission layer, wherein the light absorbing black layer comprises zinc sulfide ($ZnS_x$ ($0<x<1$)) or zinc sulfide doped with metal or a metal compound ($ZnS_x$:M ($0<x<1$, and M=metal or metal compound)).

2. The thin film EL display device as defined in claim 1, wherein the metal or metal compound M is selected from manganese, rare earth elements and halides of the rare earth elements.

3. The thin film EL display device as defined in claim 1, wherein the light absorbing black layer is disposed between the emission layer and an insulation layer formed at the back of said emission layer.

4. The thin film EL display device as defined in claim 1, wherein the light absorbing black layer is disposed between an insulation layer formed at the back of the emission layer and the opposing electrode.

5. The thin film EL display device as defined in claim 1, wherein the EL emission layer and the light absorbing layer are formed by a continuous step of sputtering.

6. The thin film EL display device as defined in claim 1, wherein the light absorbing black layer is disposed between the emission layer and an insulation layer formed at the back of said emission layer.

7. The thin film EL display device as defined in claim 1, wherein the light absorbing black layer is disposed between an insulation layer formed at the back of the emission layer and the opposing electrode.

* * * * *